US005616266A

United States Patent [19]

Cooper

[11] Patent Number: 5,616,266

[45] Date of Patent: Apr. 1, 1997

[54] RESISTANCE HEATING ELEMENT WITH LARGE AREA, THIN FILM AND METHOD

[75] Inventor: Richard P. Cooper, Whitefish, Mont.

[73] Assignee: Thermal Dynamics U.S.A. Ltd. Co.

[21] Appl. No.: 283,211

[22] Filed: Jul. 29, 1994

[51] Int. Cl.[6] ..... F27D 11/02; H05B 3/16; H05B 3/66; H05B 3/20

[52] U.S. Cl. ..... 219/543; 219/407; 219/464; 219/465; 219/468; 392/434; 392/438; 392/439

[58] Field of Search ..... 219/464, 465, 219/468, 543, 548, 407; 392/434, 438, 439

[56] References Cited

U.S. PATENT DOCUMENTS

| | | | |
|---|---|---|---|
| 2,624,823 | 1/1953 | Lytle . | |
| 3,108,919 | 10/1963 | Davis . | |
| 3,551,195 | 12/1970 | Wada et al. . | |
| 3,694,627 | 9/1972 | Blatchford et al. . | |
| 3,978,315 | 8/1976 | Martin et al. | 219/543 |
| 4,002,883 | 1/1977 | Hurko | 219/543 |
| 4,091,144 | 5/1978 | Dresner et al. . | |
| 4,168,344 | 9/1979 | Shapiro et al. . | |
| 4,196,330 | 4/1980 | Payne . | |
| 4,198,553 | 4/1980 | Dills . | |
| 4,258,080 | 3/1981 | Sonoda et al. . | |
| 4,298,789 | 11/1981 | Eichlberger et al. . | |
| 4,340,508 | 7/1982 | Wahlers et al. . | |
| 4,349,369 | 9/1982 | Van Laethem et al. . | |
| 4,870,388 | 9/1989 | Sugata et al. | 338/308 |
| 4,889,974 | 12/1989 | Auding et al. . | |
| 4,970,376 | 11/1990 | Mellor et al. . | |
| 5,039,845 | 8/1991 | Clough et al. . | |

FOREIGN PATENT DOCUMENTS

| | | |
|---|---|---|
| 3610921 | 10/1987 | Germany . |
| 56-44772 | 4/1981 | Japan . |
| 3-285057 | 12/1991 | Japan . |

OTHER PUBLICATIONS

Buffler, Charles R. *Microwave Cooking and Processing* Published by Van Nostrand Reinhold, New York.

*Primary Examiner*—Geoffrey S. Evans
*Assistant Examiner*—J. Pelham
*Attorney, Agent, or Firm*—Flehr, Hohbach, Test, Albritton & Herbert

[57] ABSTRACT

A large-area, thin film, resistance heating element (21, 46, 81) including a relatively rigid substrate (22, 63, 82), which will retain its mechanical properties at elevated temperatures, an electrically conductive film (26, 64, 84) deposited on the substrate (21, 46, 81), and electrical terminals (31, 66, 86) provided on the film (26, 64, 84). A metallic substrate (22, 63), such as a steel sheet, having an electrically insulating ceramic-based layer (23, 62, 83) thereon may be employed, or alternatively, a micanite plate or sheet (61) can be used. The substrate and film have an area which is sufficiently large that the heater can operate at maximum temperatures above 100° F. with a power density less than about 15 watts per square inch. The electrically conductive film is preferably a metal-oxide film, such as tin-oxide, and is used as a resistance heater in applications such as ovens (41) and space heaters (81) to allow delivery of substantial power at lower operating temperatures and low power densities for greater efficiency.

4 Claims, 3 Drawing Sheets

RESISTANCE HEATING ELEMENT WITH LARGE AREA, THIN FILM AND METHOD

FIELD OF INVENTION

The present invention relates, in general, to the use of thin films in resistance heating applications, and more particularly, relates to ovens and space heaters which are constructed with large-area heating panels that provide even, low-power density, efficient heating.

BACKGROUND ART

Certain metal-oxide films have been employed to heat the substrate on which they are mounted in applications requiring low-temperature heating, that is, well below 100° F. Most typically, a very thin coating of tin oxide, and particularly stannic oxide, has been deposited by vapor deposition, spraying or the like, on a large area of a glass substrate. The thin film is essentially transparent and yet capable of functioning as a resistance heater if coupled to an appropriate electrical circuit. One application of such glass panels has been to provide frost-free panels for refrigerated display cases of the type frequently used in supermarkets. A very low current can be passed through the tin-oxide film so that a sufficiently elevated temperature of the substrate or inner surface of the panel is created to prevent the condensation of water and the subsequent formation of frost, both of which interfere with the consumer's viewing of products in the display case. Such panels have not been used for heating of the air around the panels in high-temperature applications such as cooking or space heaters.

Glass panels with tin-oxide film deposited thereon also have been used in window glass and oven glass doors. In such applications, the tin-oxide film acts as a passive, infrared, reflective barrier, not as a resistance heater.

U.S. Pat. Nos. 4,970,376 and 5,039,845 also disclose apparatus in which metal-oxide films have been employed as resistance heaters. In U.S. Patent No. 4,970,376, a glass cell used in a spectroscopy device having a relatively small surface area is coated with a thin metal-oxide layer on opposite sides of the cell. The glass cell is a laboratory grade glass, which is heated by resistance heating using the metal-oxide films to a temperature of about 320° F. The resistance heating of the substrate is done in order to enhance the transparency of the cell in the spectroscopy device, not to enable use of the cell as a resistance heating element.

In U.S. Pat. No. 5,039,845, a metal-oxide film is coated on a porous mat of glass fibers. The process employs a vapor deposition which allows the metal oxide film to form on three-dimensional or porous substrates. The primary application of the resulting coated substrate is for use as an electrically conductive plate in lead-acid storage batteries. The patent also describes, however, use of such substrates as resistance heating elements by applying a potential across the coated substrate. An advantage of using the porous fiberglass mats is urged in the patent to be that the resulting heating element would also be flexible. The possible application of such heating elements to culinary purposes, such as warming tables, low-temperature ovens, as well as to de-icing devices and high-temperature heating of gases and liquids is described. Chemical vapor deposition, however, is a relatively expensive process by comparison, for example, to spraying a tin-oxide film onto a substrate.

Further background in connection with the coating of substrates with metal-oxide films and variation of the resistance of such films to the passage of electricity therethrough can be found in U.S. Pat. Nos. 4,349,369 and 4,258,080, respectively.

It is also known that metal-oxide films can be used as resistance heaters in microwave cooking. Thus, various glass and porcelain substrates have had tin-oxide films deposited thereon in various patterns so that when placed in a microwave oven, the film will couple with the microwave energy and produce localized heating of the surface on which it is deposited. In each case, such applications have been limited to containers or food support surfaces that are placed in the microwave oven compartment.

While the patent and other literature have suggested the possibility of using tin-oxide films as resistance heating elements, there are, in fact, no known commercial uses of such devices other than in microwave cooking containers. The various suggestions in the prior art have all had practical drawbacks. Thus, the use of glass substrates tends to require relatively costly, high-temperature, laboratory or PYREX glass. Flexible mats and glass-based sheets have structural drawbacks, and as they are rigidified through various resins and the like, they also can be subject to thermal stress cracking and shattering, particularly at high temperatures. Moreover, expensive chemical vapor deposition techniques may be required for adequate bonding to flexible substrates.

Further, there is a great need for enhanced efficiency of energy conversion in ovens, which typically make very poor use of energy in cooking foods. A Cal rod-type resistance heated oven, for example, typically operates with the rod heating element at about 1500° F. to bring the air temperature in the oven up to useable cooking temperatures, for example, 250° F. to 550° F. Moreover, a 5/16 inch diameter resistance rod-type oven heater will operate at a power density over 40 watts per square inch. The Department of Energy is highly likely to adopt regulations requiring the efficiency of ovens to be noted for consumers on the oven labeling, much as has been done for water heaters, refrigerators and the like. When such requirements are introduced, the extremely low efficiency of ovens using rod-type resistance heating elements will be made readily apparent to consumers.

Accordingly, it is an object of the present invention to provide a resistance heating element suitable for use in an oven having substantially improved efficiency and a greatly reduced power density.

Another object of the present invention is to provide an improved resistance heating element which makes much more efficient use of electrical energy in cooking applications than rod-type resistance heaters.

Still a further object of the present invention is to provide a resistance heating element which is durable, does not pose a safety hazard, has low temperature gradients, and will not be destroyed by thermal stress concentrations.

A further object of the present invention is to provide an oven for cooking of food products which provides a more even heating of the products in the cooking area.

Still another object of the present invention is to provide a resistance heating element which can be used as a highly efficient space heater.

A further object of the present invention is to provide a method of forming a resistance heating element which reduces the amount of energy required to create the heating element.

The heating element, oven and method of the present invention have other objects and features of advantage which will become apparent from, or are set forth in more detail in the following description of the Best Mode of Carrying Out the Invention and the accompanying drawing.

SUMMARY OF THE INVENTION

The heating element of the present invention is comprised, briefly, of a relatively rigid substrate which is formed of a material which retains its mechanical properties at temperatures above 100° F., and a thin electrically conductive film deposited on the substrate in a position electrically isolated from ground to a resistance heating element. The substrate and film further have an area sufficiently large to cause said heating element to operate at a power density of less than about 10 watts per square inch at the maximum operating temperature of the heating element. In the preferred embodiment, the substrate is provided by a metallic sheet having a ceramic-based layer deposited thereon. The thin film may be provided by a tin-oxide film. The oven of the present invention is comprised, briefly, of a housing having walls defining therebetween a food-receiving cooking volume. The walls include at least one wall formed by the heating element of the present invention, and an electrical control circuit is connected to the metal-oxide film for control of current flow through the film to vary the amount of resistance heating produced by the film. The walls of the oven preferably are formed from a porcelainized-metal/micanite sandwich with the thin film in between.

The method for coating a metal-oxide film onto a substrate of the present invention is comprised, briefly, of the steps of coating at least one side of a metal substrate with a ceramic-based layer, bonding the ceramic-based layer to the metal substrate by applying sufficient heat thereto to effect bonding, and while the substrate and ceramic-based layer are hot from the bonding step, depositing a metal-oxide film on the ceramic-based layer.

BEST MODE OF CARRYING OUT THE INVENTION

The resistance heating element of the present invention is particularly well suited for use in culinary applications. It can be used in large area, high-power applications, for example, in ovens, where it will significantly enhance the energy efficiency of the oven. The large area of the heating element allows substantial power to be delivered, but at a very low average power density. Moreover, the present resistance heating element is durable and not damaged by thermal shock. It also can be employed as an effective food warming or holding surface, a space heater, and even has applications in the automotive industry to heat the interior of automobiles.

Figure 1:
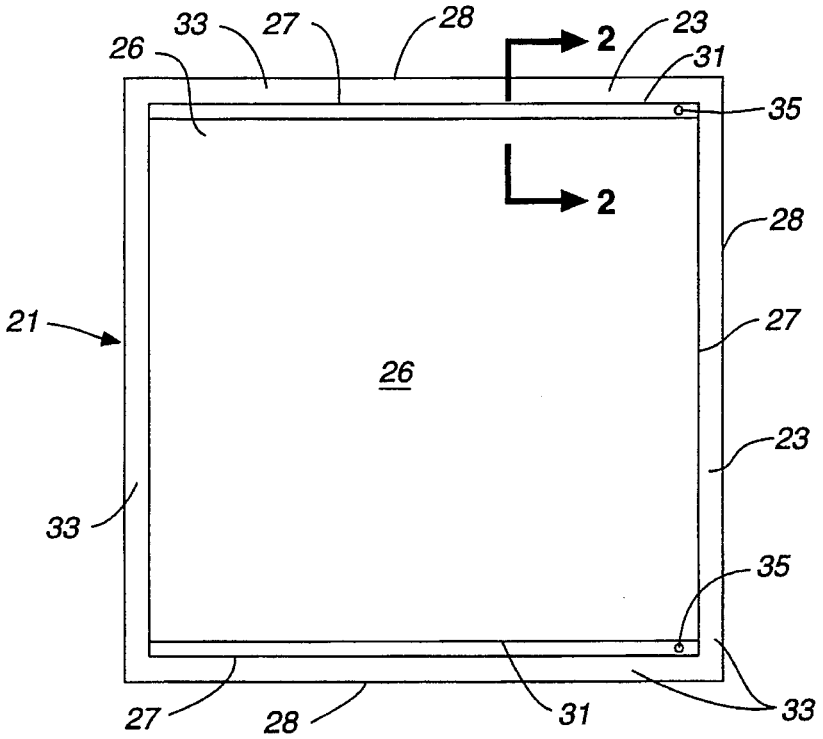
FIG. 1 is a front elevation view of a heating element constructed in accordance with the present invention.
Figure 2:
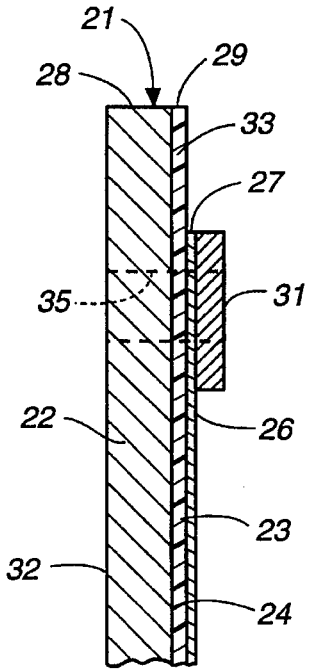
FIG. 2 is a fragmentary, enlarged, side elevation view, in cross section, taken substantially along the plane of line 2—2 in FIG. 1.

FIGS. 1 and 2 illustrate one embodiment of a resistance heating element, generally designated 21, constructed in accordance with the present invention. Heating element 21, as best seen in FIG. 2, includes a substrate 22 which is relatively rigid and maintains its mechanical or structural integrity at elevated temperatures for example, in excess of at least 100° F. As shown in FIG. 1, substrate 22 is a metal substrate on which an electrically insulating ceramic-based layer 23 has been secured, preferably thermally bonded, to at least one side or surface 24 of the substrate. Deposited on electrically insulting layer 23 is an electrically conductive, thin, large area film 26, which is in a position that is electrically isolated from metal substrate 22 and ground. As can be seen from FIG. 2, the end 27 of film 26 is recessed inwardly from the ends 28 and 29 of substrate 22 and ceramic-based layer 23, respectively. Finally, the heating element includes a pair of spaced-apart electrical terminals 31 provided on conductive film 26 for electrical connection of the film to a source of electricity, in a manner which will be described more fully hereinafter.

In order to provide for improved efficiency in applications such as ovens and space heaters, in which substantial power and operating temperatures in excess of 100° F. are required, resistance heating element 21 further is constructed so that substrate 22 and thin film 26 have a surface area which is sufficiently large that the heating element can operate at a power density less than about 15 watts per square inch, and preferably under 10 watts per square inch, at maximum operating temperatures. Thus, in an oven application, for example, the resistance heater of the present invention, in panel of 18 inches by 18 inches and having 2000 watts of power applied to the panel, will operate at temperatures above 300° F. and will have a power density of 6.17 watts per square inch. A conventional 5/16 inch diameter, four foot long, Cal-rod oven, by contrast, operating with the resistance heating rod at 1500° F. and having 2000 watts of energy applied, will have a power density of over 42 watts per square inch.

The heating element of the present invention employs as a basic structural element a substrate 22 which will maintain its structural integrity or be self-supporting at the maximum operating temperatures of the heater. A thin steel sheet is well suited for use in forming a substrate for the present heater. Thus, a 12 to 20 gauge, cold-rolled, carbon steel sheet is preferred and may be conveniently used with an electrically insulating layer as a highly durable substrate which can be formed into a wide variety of shapes and which will be self-supporting at temperatures well in excess of 100° F. in panels having large enough areas to maintain the maximum operating power density below 15, and preferably below 10, watts per square inch.

Figure 4:
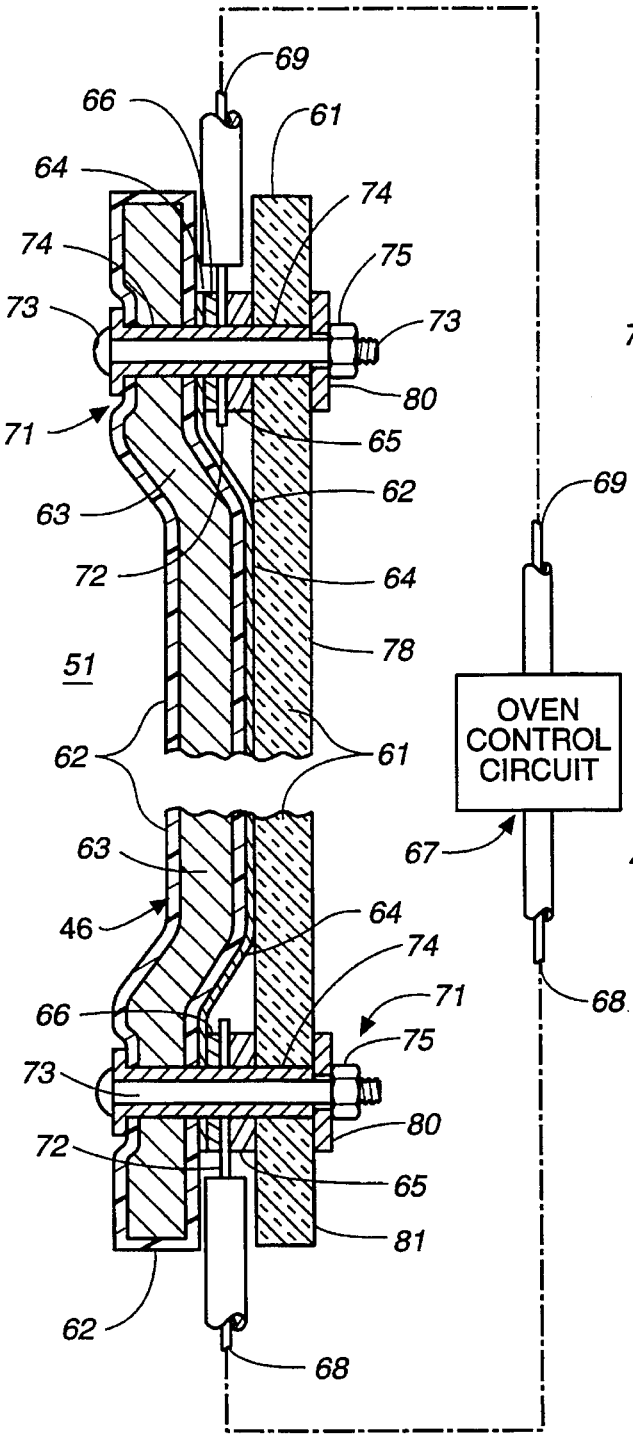
FIG. 4 is a fragmentary, enlarged, side elevation view, in cross section, of one of the walls of the oven of FIG. 3 taken substantially along the plane of line 4—4 in FIG. 3.

If a metallic substrate 22 is employed, however, it must be electrically isolated from conductive film 26 in order to prevent the substrate from becoming a part of the electrical circuit. Accordingly it is preferred that a ceramic-based layer, such as porcelain, enamel, ceramic-containing or glass-containing high temperature non-conductive paint, be placed over an area of substrate 22 on which film 26 is to be deposited. As shown in FIG. 2, layer 23 is deposited on one side 24 of substrate 22. It will be understood, however, and as is shown in FIG. 4, ceramic-based layer 23 can cover opposite side 32 and peripheral edge 28 of substrate 22 so as to completely encapsulate a metallic substrate.

The thickness of ceramic-based layer 23 is not extremely critical. It need only by thick enough to ensure that the electrically conductive film 26 is electrically isolated from metal substrate 22. A porcelain or enamel layer 23, for example, a few thousandths of an inch in thickness can be employed, with the enamel or porcelain being sprayed or dipped onto substrate 22 and then baked to bond the same to the metal in a manner which will be described in more detail in connection with FIG. 5.

Electrically conductive film 26 most preferably is provided by a very thin film of a conductive metal-oxide, for example, stannic oxide ($SnO_2$). The stannic oxide or tin-oxide film 26 can be deposited as a very thin film, for example, 2 microns or less. In FIG. 2, the thickness of the metal-oxide film 26 has been increased for purposes of illustration, and in fact the relative thicknesses of substrate 22 and layer 23 also are not shown to scale. Thicker, but still relatively thin films of nitrides, borides or carbides also may be suited for use in the present invention, but tin-oxide is the preferred film material.

The tin-oxide film is most desirably deposited using a spray gun which atomizes and blows the tin-oxide producing chemicals onto baked ceramic-based layer 23, in a manner which also will be described in more detail in connection with FIG. 5. Chemical vapor deposition, as opposed to spraying or atomizing, is expensive and not preferred or required to form the heating element of the present invention. While it is possible to mask the peripheral edge 33 of layer 23 during deposit of the conductive film, more typically, film 26 will be deposited over the entire porcelain or enamel layer 23 and thereafter removed at marginal edges 33, for example, by employing a mask and sandblasting. This leaves a marginal edge 33 extending around the periphery of the sheet heating element 21 which peripheral margin ensures electrical isolation from substrate 22 and provides an area which will allow mounting of the heating element in a framework or mounting assembly.

Spaced-apart electrical terminals 31 are preferably provided on film 26 by elongated bus bar strips which extend along opposed edges of film 26 so as to distribute current substantially evenly to the metal-oxide film over a substantial area of the film. As will be seen in FIG. 1, a bus bar strip is provided along the upper edge of film 26 and a second strip extends over the full length of the lower edge of the film. The bus bar terminals 31 can be formed by silk screening techniques using, for example, nickel-silver alloy, to form the bus bar. Typically, strips 31 will have a thickness of about 0.001 to 0.002 inches and most preferably extend over substantially the entire length of opposed edges of film 26. It will be understood, however, that other terminal configurations can be employed within the scope of the present invention, and it may be possible in some applications to simply electrically couple directly to spaced-apart areas of film 26, which areas will act as terminals.

Large-area, electrical heating elements constructed as shown and described in connection with FIGS. 1 and 2 have been found to be capable of temperatures in excess of 500° F. Moreover and more importantly, such large area heating panels allow operation at high power levels, for example 1000 watts, but at lower power densities, for example, 2 watts per square inch to produce an extremely even heat at lower temperatures without significant hot spots or intolerable thermal gradients over the area of the panel. Thus, as a result of the large area and the even distribution of current through film 26 on heating panel 21, the panel advantageously can be used to construct an oven which has significantly improved efficiency over conventional ovens.

Figure 3:
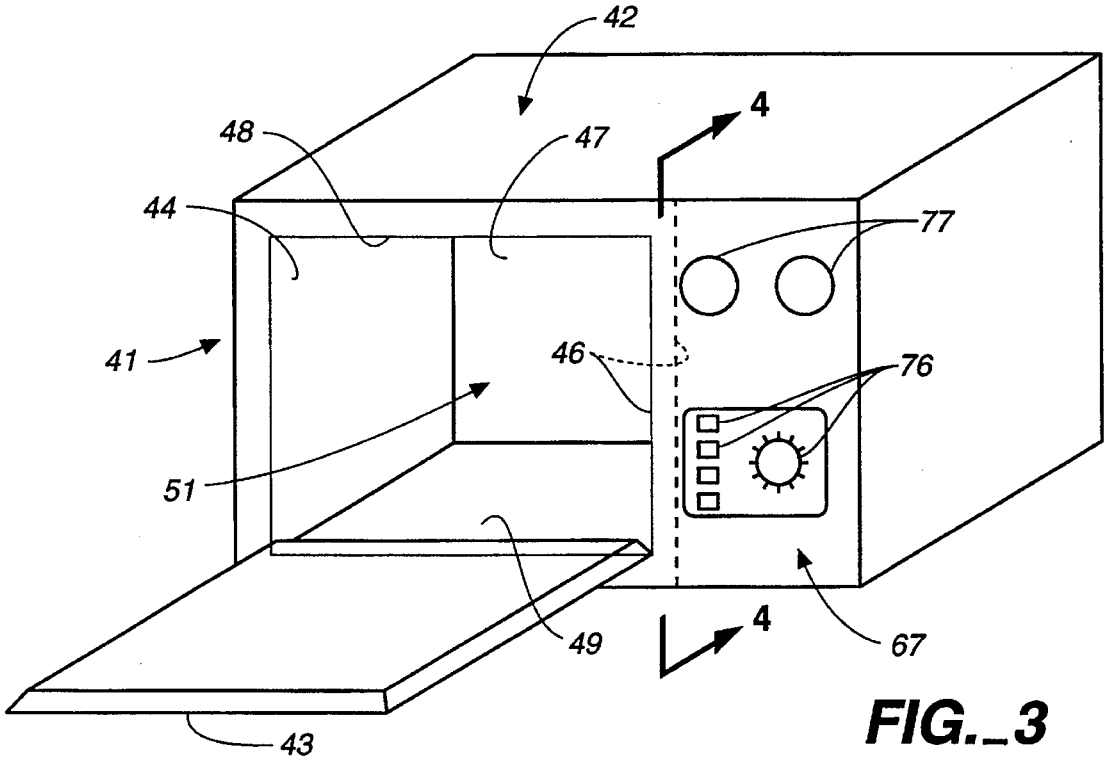
FIG. 3 is a top perspective view of an oven constructed using the heating element of the present invention.

FIGS. 3 and 4 illustrate the use of a resistance heating element constructed in accordance with the present invention and employed in connection with an oven, generally designated 41. Oven 41 includes a housing 42 with a movable door 43, a pair of side walls 44 and 46, a back wall 47 and top and bottom walls 48 and 49. Together, the walls and door define a central food-receiving cooking volume 51. At least one of the walls or door 43 defining cooking volume 51 includes a large area, thin film, resistance heating element of the type described in connection with FIGS. 1 and 2. Most preferably, walls and the door are all provided with such panels so that the food in cooking volume 51 is surrounded by heating panels. It will be understood, however, that fewer than all the oven walls may be provided as resistance heating panels constructed in accordance with the present invention.

FIG. 4 shows the preferred form of oven heating panels for use in oven assembly 41. In the panel of FIG. 4, a tin-oxide film 64 has been deposited on a relatively rigid, and high-temperature stable, substrate, namely, a sheet of steel 63 having an enamel layer 62 bonded thereto. Mounted in abutting relation to the steel and enamel substrate is a sheet 61 of an electrically and thermally insulating material, such as micanite. Micanite sheets are commercially available which are formed from Muscovite or Phlogopite mica-paper and a heat resistant binder. Such sheets of micanite, for example, are available in thicknesses of 0.004 to 0.080 inches and are sold under the trademark COGEMICANITE 505 by Cogebi, Inc. of Dover, N.H. Micanite sheets will retain the mechanical or structural properties at sustained temperatures up to 900° F.

In the panel assembly of FIG. 4, the steel and ceramic substrate 63, 62 has tin-oxide film 64 deposited on a side opposite cooking volume 51. Micanite sheet 61 is an electrical insulator and thus conductive film 64 is electrically isolated from outwardly facing side 78 of the oven, which affords greater safety. In order to electrically couple an oven control circuit, generally designated 67, to film 64, mechanical coupling assemblies, generally designated 71, can be used to clamp leads 72 of conductors 68 and 69 to bus bar strips 66. In the preferred form, clamping assemblies 71 are provided and a bolt 73 which passes through an electrically insulating washer and sleeve 74. The outwardly facing end of bolt 73 is secured by a nut 75 and a washer 80.

Thus, electrically conductive lead 72 is pulled by nut 75, bolt 73 and electrically insulating washer and sleeve 74 and spacer washer 65 down against bus bar strip 66, but washer and sleeve 74 electrically isolate bolt 73, nut 75 and washer 80 from outwardly facing side 78 of the heating panel. Mechanical clamping assemblies are preferred over soldering in that oven temperatures in excess of 500° tend to melt conventional soldered connections. It will appreciated, however, that there are a wide variety of other mechanical couplings and high-temperature, non-mechanical couplings which could be used to connect conductors 68 and 69 to oven control circuit 67.

Oven control circuit 67 can be constructed in a conventional manner and would include conventional user input and setting devices 76, as well as indicator devices 77 (FIG. 3), as are well known in the industry.

In FIG. 4, sheet 63 is shown with slightly bent or formed edges to accommodate mechanical clamping assembly 71.

The amount of deformation shown in FIG. 4, however, is exaggerated by reason of the exaggerated showing of the thickness of the various panel layers. The sandwich of sheets 61 and 63 with thin film 64 in between can be held in place by oven framework (not shown) or by fastener assemblies.

Tin-oxide films are highly infrared reflective. Accordingly, while they act as resistance heaters, they also tend to dissipate energy inwardly toward ceramic layer 62 and steel substrate 63. This, in turn, results in a very even heat emanating from the side of the heating element facing cooking volume 51. It should be noted that an additional feature of micanite sheet 61 is that it is a thermal insulating material which provides a barrier on the side of the panel opposite cooking volume 51. Metal sheet 63 also will have high thermal conductivity and be efficient in effecting even heat transfer from film 64 to the cooking volume side of the panel assembly. The use of a porcelainized surface 62 on the inside of the panel facing cooking volume 51 is highly advantageous so as to provide a smooth, substantially pore-free surface which can be cleaned and will not trap or become contaminated food. This is an essential requirement to meet federal regulations concerning food cooking surfaces, particularly in ovens used for commercial food preparation.

Figure 4A:
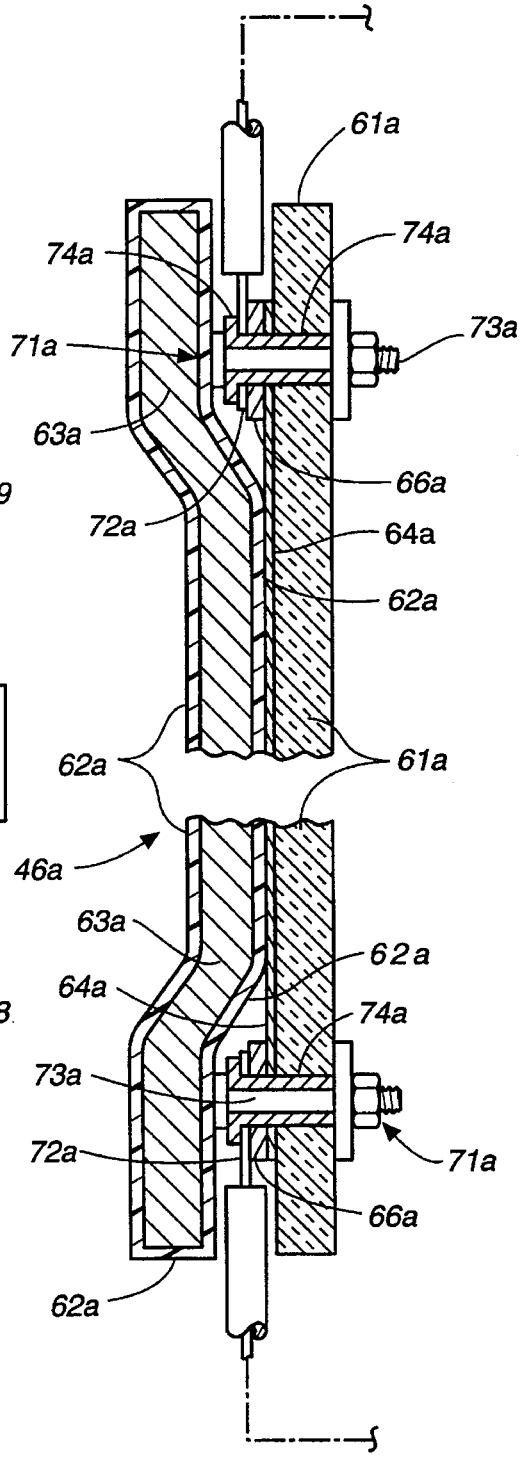
FIG. 4A is a fragmentary, enlarged side elevation view, in cross section, of an alternative embodiment of the oven wall of FIG. 3.

It is believed that micanite sheet 61 also may act as a substrate for the resistance heater of the present invention. Accordingly, FIG. 4A shows an oven wall assembly 46*a* in which thin film 64*a* has been deposited on micanite sheet 61*a*. Metallic sheet 63*a* with enamel layer 62*a* are merely held against the micanite sheet by the wall mounting assembly, not shown.

Mechanical coupling assemblies 71*a* couple leads 72*a* to bus bars 66*a* in a manner similar to FIG. 4 except washer/sleeve 74*a* is shortened and bolt 73*a* does not extend to the inside of the oven.

Some problems have been encountered, however, with direct spraying of tin-oxide forming chemicals onto micanite.

Other forms of conductive thin films may be required or a pre-surfacing or coating of the micanite may be necessary if tin-oxide is used and deposited as shown in FIG. 4A.

Figure 6:
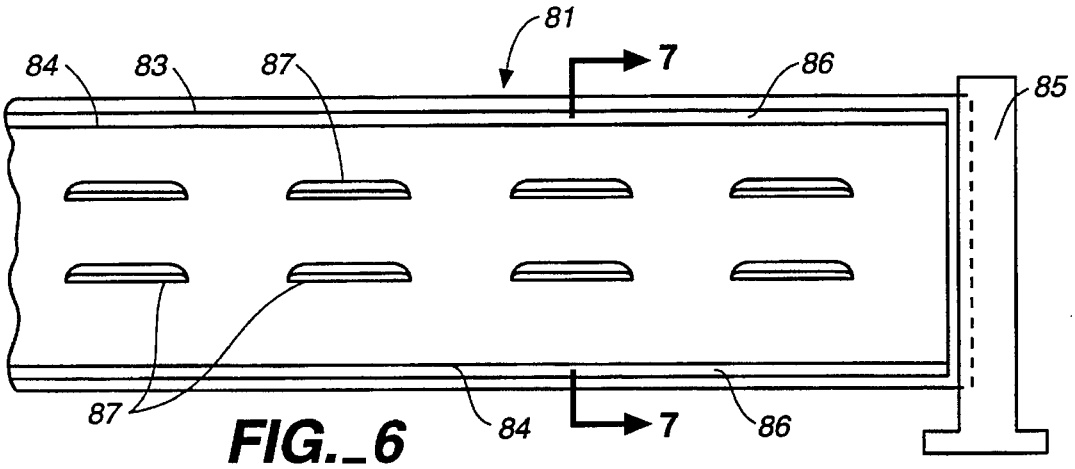
FIG. 6 is a front elevation view of a space heating panel constructed in accordance with the present invention.
Figure 7:
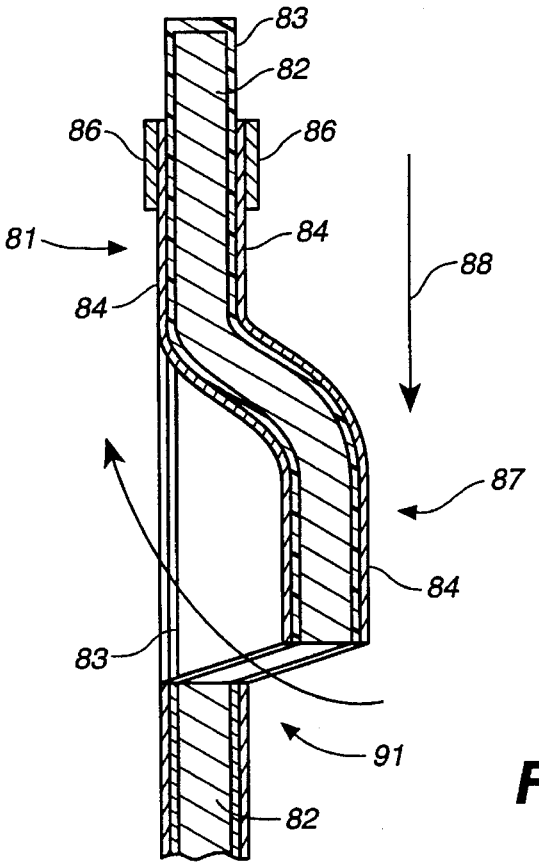
FIG. 7 is a fragmentary enlarged side elevational view, in cross section, taken substantially along line 7—7 in FIG. 6.

FIGS. 6 and 7 illustrate the use of a large-area heating element constructed in accordance with the present invention as a space heater. Heating element 81 is formed as an elongated member of the type typically used in baseboard heating applications. The support framework 85 holds a heating element which may be formed as a metallic or sheet steel substrate 82 on which a ceramic-based layer 83 has been baked. In the form of the element shown in FIG. 7, a metal-oxide film 84 has been deposited on both sides of the substrate on top of layer 83. Strip-like bus bars 86 are provided on each side of substrate 82 and are coupled electrically to a control circuit (not shown).

In the space heater of FIGS. 6 and 7, substrate 82 has been punched with a plurality of louvers 87 which enhance convection heat transfer. In the preferred form, louvers 87 are on the interior side of the panel so that downwardly sinking cool air, as represented by arrow 88, from a window or along a wall will first pass over the inwardly extending louver 87 and then, as it is heated, return upwardly and outwardly, as indicated by arrow 89, into the room side of the heater. A louvered heating element 81 also could be formed by casting a micanite panel with louvers 87.

One of the substantial advantages Of the heating element of the present invention, therefore, is that it can be employed in panel surfaces having substantial discontinuities. Thus, openings 91 formed by the louvers in panel 81 do not result in substantial and intolerable hot spots over the panel. Current flow across a continuous film path across the panel through the resistance heating film 84 will be sufficiently uniform that the entire panel will be within about 10° F. of the average panel temperature at about 300° F. Thus, the heating element of the present invention can employ fins, louvers and other types of discontinuities to enhance heat transfer in various applications without producing extreme or intolerable thermal concentrations or gradients. Moreover, the large panel area allows delivery of substantial total power without watt density in excess of 15 watts per square inch or high operating temperatures. For the same power delivery in a conventional space heater, higher and more hazardous heating element operating temperatures must be used.

Figure 5:
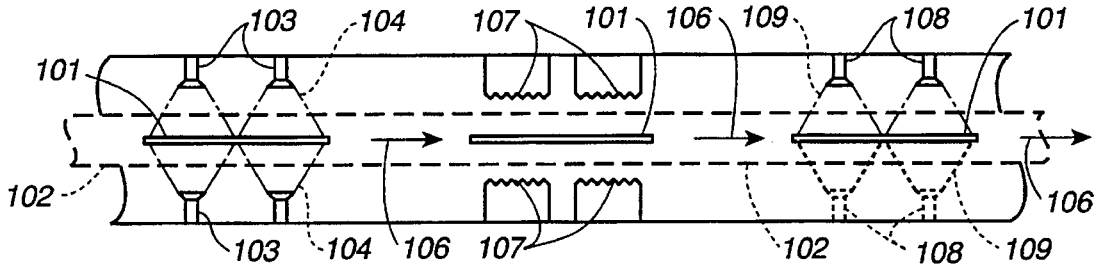
FIG. 5 is a top plan view of a schematic representation of a process for forming the resistance heating element of the present invention.

Manufacture of the heating element of the present invention using an improved method of the present invention can be best understood by reference to the schematic representation of FIG. 5. Steel sheets or substrates 101 can be mounted to conveyor means 102, such as an overhead conveyor. The panels are then advanced between opposed ceramic-layer depositing spray apparatus 103 which deposit a spray 104 of, for example, porcelain, enamel or a high-temperature, ceramic-containing non-conductive paint 104 on panels 101. As seen in FIG. 5, ceramic-containing material 104 is being sprayed on both sides of panels 101.

Panels 101 are advanced by conveyor 102 from the coating station in the direction of arrows 106 to a heating or ceramic bonding station at which heating elements, for example resistance heaters 107, are used to bake the sprayed-on ceramic layer to thereby bond the layer to the metallic substrate. This baking process typically elevates the temperature of panels 101 up to 1000° F., or more, and requires substantial energy.

In the improved process of the present invention, the porcelainized panel is then immediately advanced to a film depositing station and coated with tin-oxide film while the panel is still hot from baking. Conventional vapor deposit or spraying techniques used to deposit the chemicals forming the tin-oxide film require that the panels be at a very high temperature, for example, 1500° F. If the panels are allowed to cool after having a layer of porcelain deposited on the metal substrate, bringing them up to a temperature sufficient for tin-oxide film deposition will result in a substantial waste of energy. Accordingly, in the process of the present invention at the heating station, heaters 107 are preferably used to not only bake the enamel or porcelain onto the substrate, but to elevate the entire substrate mass to a level sufficient to enable immediate spraying of tin-oxide film on top of the ceramic-based layer. Thus, the metal-oxide film spraying apparatus 108 is immediately proximate at least one side of panel 101 so that tin-oxide forming materials 109 can be sprayed on the panel 101 while it is still at an elevated temperature.

The present invention, therefore, includes a method comprised of the steps of coating a metal substrate with a ceramic-based layer, for example, at sprayers 103. The next step in the present method is to bond the layer at heating elements 107, and finally while the substrate and ceramic-based layer are hot from the bonding step depositing a metal-oxide film on ceramic-based layer. This is preferably accomplished in a continuous process with the bonding step at a temperature sufficient for the metal-oxide film deposition step.

It would also be possible to continue the process further down the line after the film deposition step by placing a mask over one or both sides of the panel and sandblasting the metal-oxide film from a margin of the panels to provide a film-free periphery for receipt of the panel in a mounting assembly and to ensure isolation from the metallic substrate.

What is claimed is:

1. A resistance heating element comprising:

a relatively rigid sheet of substrate material capable of being self-supporting at maximum operating temperatures in excess of 100° F., said sheet of substrate material having a nonconductive surface formed with discontinuities therein in the form of at least one of a plurality of openings therein and a plurality of protrusions therefrom;

an electrically conductive, thin film deposited on said surface and electrically isolated from ground to provide an electrical resistance heating element upon coupling to a source of electricity;

a pair of electrical terminals electrically coupled to said thin film in spaced apart relation for the flow of electrical current therebetween; and said thin film having a continuous path across said surface between said terminals.

2. The resistance heating element as defined in claim 1 wherein, said thin film is provided by a metal oxide film having a thickness of about 2 microns or less; and said substrate and thin film have an area sufficient in size for use as one of a food cooking device and a space heater.

3. The resistance heating element as defined in claim 2 where in, said substrate material has discontinuities in the form of protrusions in said surface, and said thin film is provided by a tin oxide film deposited in a substantially uniform film extending over said protrusions.

4. The heating element as defined in claim 1 wherein, said substrate material is formed with discontinuities in the form of a plurality of louvers providing said openings in said surface, and said thin film is a metal-oxide film extending over said louvers.

* * * * *